US008128757B2

(12) United States Patent
Nagata et al.

(10) Patent No.: US 8,128,757 B2
(45) Date of Patent: Mar. 6, 2012

(54) METHOD OF MANUFACTURING ORIENTED BODY, MOLDED BODY AND SINTERED BODY AS WELL AS METHOD OF MANUFACTURING PERMANENT MAGNET

(75) Inventors: Hiroshi Nagata, Ibaraki (JP); Yoshinori Shingaki, Ibaraki (JP)

(73) Assignee: Ulvac, Inc., Kanagawa (JP)

( * ) Notice: Subject to any disclaimer, the term of this patent is extended or adjusted under 35 U.S.C. 154(b) by 345 days.

(21) Appl. No.: 12/515,551

(22) PCT Filed: Nov. 19, 2007

(86) PCT No.: PCT/JP2007/072392

§ 371 (c)(1),
(2), (4) Date: May 20, 2009

(87) PCT Pub. No.: WO2008/062757

PCT Pub. Date: May 29, 2008

(65) Prior Publication Data

US 2010/0034688 A1 Feb. 11, 2010

(30) Foreign Application Priority Data

Nov. 21, 2006 (JP) ..... 2006-313827
Jan. 11, 2007 (JP) ..... 2007-003400

(51) Int. Cl.
*H01F 1/03* (2006.01)
*C21D 1/02* (2006.01)

(52) U.S. Cl. ..... 148/105; 148/108; 419/38

(58) Field of Classification Search ..... 148/105, 148/108; 419/38
See application file for complete search history.

(56) References Cited

U.S. PATENT DOCUMENTS 5,666,635 A 9/1997 Kaneko et al.
5,993,732 A 11/1999 Nakayama et al.
7,045,092 B2 * 5/2006 Ogawa et al. ..... 419/38
7,314,530 B2 * 1/2008 Harada et al. ..... 148/103
7,534,311 B2 * 5/2009 Tomizawa et al. ..... 148/302
7,931,756 B2 * 4/2011 Kuniyoshi et al. ..... 148/105

FOREIGN PATENT DOCUMENTS

CN 1130289 A 9/1996

(Continued)

OTHER PUBLICATIONS

ASM Handbook, Ferguson et al. "vol. 7, Powder Metal Technolgies and Applications; Powder Shaping and Consolidation Technologies." dowloaded from http://products.asminternational.org/hbk/do/highlight/content/V07/D03/A01/S0068013.html on Jul. 28, 2001. Copyright 2002 ASM International.*
Goldfarb et al. "Units for Magnetic Properties" downloaded from http://www.magneticmicrosphere.com/resources/Units_for_Magnetic_Properties.pdf on Jul. 27, 2011. Published Mar. 1985.*

(Continued)

*Primary Examiner* — George Wyszomierski
*Assistant Examiner* — Tima M McGuthry Banks
(74) *Attorney, Agent, or Firm* — Cermak Nakajima LLP; Tomoko Nakajima

(57) ABSTRACT

There is provided a method of manufacturing a permanent magnet having extremely high orientation by arranging such that the crystal fractures of alloy raw meal powder having more equal crystal orientational relationship are combined in magnetic field. In this invention, alloy raw meal powder is filled into a cavity and, while agitating the alloy raw meal powder inside the cavity, is oriented in the magnetic field. This oriented body is then compression molded in the magnetic field into a predetermined shape.

20 Claims, 12 Drawing Sheets

FOREIGN PATENT DOCUMENTS

| | | | |
|---|---|---|---|
| JP | 1-124208 | | 5/1989 |
| JP | 9-31608 | | 2/1997 |
| JP | 11-31610 | | 2/1999 |
| JP | 2006-228937 | | 8/2006 |
| RU | 2113742 | C1 | 6/1998 |
| SU | 1457277 | A1 | 3/1998 |
| WO | WO02/060677 | | 8/2002 |

OTHER PUBLICATIONS

International Search Report for PCT Patent App. No. PCT/JP2007/072392 (Feb. 12, 2008).

Official Action issued in Russian Patent App. No. 2009123435 (Oct. 11, 2011) with English language translation thereof.

* cited by examiner

PADDLE VANE

RIBBON VANE

ANCHOR VANE

FIG.9

| | ROTARY AGITATION | HORIZONTAL AGITATION | MOLDING METHOD | MAGNETIC PROPERTIES OF JIG | ADDITION OF SOLID LUBRICANT | ADDITION OF LIQUID LUBRICANT | METHOD OF MOLDING ALLOY RAW MATERIAL | Br(kG) | BHmax (MG0e) | iHc(k0e) | ORIENTATION (%) |
|---|---|---|---|---|---|---|---|---|---|---|---|
| COMPARATIVE EXAMPLE | NO | | UNIAXIAL PRESSURIZING | — | NO | NO | BOOK MOLD | 13.9 | 46.8 | 14.2 | 92 |
| EXAMPLE | YES | NO | | NON-MAGNETIC | | | | 14.5 | 51.5 | 14.0 | 96 |
| EXAMPLE | NO | YES | | NON-MAGNETIC | | | | 14.5 | 51.2 | 14.1 | 96 |
| EXAMPLE | YES | NO | | MAGNETIC | | | | 14.2 | 42.7 | 14.2 | 94 |
| EXAMPLE | | | ISOSTATIC | NON-MAGNETIC | | | | 14.7 | 53.0 | 14.1 | 97 |
| COMPARATIVE EXAMPLE | NO | | UNIAXIAL PRESSURIZING | — | YES | | | 13.9 | 47.5 | 14.2 | 93 |
| EXAMPLE | YES | | | NON-MAGNETIC | | | | 14.8 | 53.7 | 14.0 | 98 |
| COMPARATIVE EXAMPLE | NO | | | — | NO | YES | | 13.9 | 47.5 | 14.2 | 93 |
| EXAMPLE | YES | | | NON-MAGNETIC | | | | 14.8 | 53.8 | 14.0 | 98 |
| COMPARATIVE EXAMPLE | NO | | | — | YES | | STRIP CASTING | 13.7 | 45.8 | 14.2 | 91 |
| EXAMPLE | YES | | | NON-MAGNETIC | | | | 14.9 | 54.4 | 14.0 | 98 |
| EXAMPLE | YES | | | NON-MAGNETIC | | | CENTRIFUGAL CASTING | 14.9 | 54.2 | 14.0 | 98 |
| EXAMPLE | YES | | ISOSTATIC | NON-MAGNETIC | | | | 15.2 | 57.0 | 14.0 | 99.8 |

FIG.10

| | ROTARY AGITATION | MOLDING PRESSURE (t/cm²) | REJECTION RATE DUE TO CRACKS AND NOTCHES IN SINTERED BODY (%) | Br(kG) | BHmax (MG0e) | iHc(k0e) | ORIENTATION (%) |
|---|---|---|---|---|---|---|---|
| COMPARATIVE EXAMPLE | NO | 0.05 | 45 | 14.1 | 48.7 | 14.0 | 94 |
| | | 0.1 | 10 | 14 | 48.0 | 14.0 | 93 |
| | | 0.2 | 8 | 13.9 | 47.3 | 14.1 | 92 |
| | | 0.4 | 5 | 13.7 | 45.8 | 14.2 | 91 |
| | | 0.6 | 4 | 13.7 | 45.5 | 14.2 | 91 |
| | | 0.7 | 3 | 13.6 | 45.0 | 14.2 | 91 |
| | | 0.8 | 2 | 13.6 | 44.8 | 14.2 | 91 |
| | | 1 | 2 | 13.5 | 44.7 | 14.3 | 90 |
| | | 2 | 1 | 13.5 | 44.5 | 14.3 | 90 |
| THIS INVENTION | YES | 0.05 | 8 | 15 | 55.2 | 14 | 99 |
| | | 0.1 | 0 | 15 | 55 | 14 | 99 |
| | | 0.2 | 0 | 14.9 | 54.8 | 14 | 98 |
| | | 0.4 | 0 | 14.9 | 54.4 | 14 | 98 |
| | | 0.6 | 0 | 14.8 | 53.7 | 14 | 98 |
| | | 0.7 | 0 | 14.7 | 52.9 | 14 | 97 |
| | | 0.8 | 0 | 14.6 | 52.2 | 14 | 97 |
| | | 1 | 0 | 14.5 | 51.5 | 14 | 96 |
| COMPARATIVE EXAMPLE | | 2 | 3 | 14.2 | 49.2 | 14 | 94 |

FIG.11

| | KIND OF MAGNETIC FIELD | INTENSITY(k0e) OF ORIENTATION MAGNETIC FIELD(PEAK) | Br(kG) | BHmax (MG0e) | iHc(k0e) | ORIENTATION (%) |
|---|---|---|---|---|---|---|
| | PULSE MAGNETIC FIELD | 5 | 14.0 | 47.8 | 14.2 | 93 |
| EXAMPLE | | 7 | 14.1 | 48.7 | 14.2 | 94 |
| | | 10 | 14.3 | 50.5 | 14.1 | 95 |
| | | 13 | 14.5 | 51.2 | 14.1 | 96 |
| | | 16 | 14.7 | 53.0 | 14.0 | 97 |
| | | 20 | 14.8 | 54.5 | 14.0 | 97 |
| | | 24 | 14.9 | 55.5 | 14.0 | 98 |
| | | 30 | 14.9 | 55.8 | 14.0 | 98 |
| | | 40 | 15.0 | 56.0 | 14.0 | 99 |
| | | 50 | 15.0 | 56.2 | 14.0 | 99 |
| COMPARATIVE EXAMPLE | STATIC MAGNETIC FIELD | 3 | 14.1 | 48.5 | 14.2 | 94 |
| EXAMPLE | | 5 | 14.3 | 50.3 | 14.2 | 95 |
| | | 7 | 14.5 | 51.0 | 14.1 | 96 |
| | | 10 | 14.7 | 52.8 | 14.1 | 97 |
| | | 13 | 14.8 | 53.2 | 14.0 | 98 |
| | | 16 | 14.9 | 54.4 | 14.0 | 98 |
| | | 20 | 15.0 | 56.1 | 14.0 | 99 |
| | | 24 | 15.0 | 56.2 | 14.0 | 99 |
| COMPARATIVE EXAMPLE | | 30 | 15.0 | 56.3 | 14.0 | 99 |

FIG.12

| SOLID LUBRICANT | LIQUID LUBRICANT | Br(kG) | BHmax (MG0e) | iHc(k0e) | ORIENTATION (%) |
|---|---|---|---|---|---|
| 0 | 0 | 14.2 | 49.5 | 14.3 | 95 |
| 0.01 | 0 | 14.3 | 49.8 | 14.2 | 95 |
| 0.02 | 0 | 14.3 | 50.5 | 14.2 | 96 |
| 0.04 | 0 | 14.7 | 52.7 | 14.1 | 97 |
| 0.08 | 0 | 14.8 | 54.5 | 14.0 | 98 |
| 0.1 | 0 | 14.9 | 55.0 | 14.0 | 99 |
| 0.2 | 0 | 15.0 | 46.4 | 9.3 | 99 |
| 0 | 0.02 | 14.2 | 49.8 | 14.2 | 95 |
| 0 | 0.05 | 14.3 | 50.3 | 14.1 | 96 |
| 0 | 0.1 | 14.8 | 53.2 | 14.0 | 98 |
| 0 | 0.5 | 14.8 | 53.5 | 14.0 | 99 |
| 0 | 1 | 14.9 | 55.4 | 14.0 | 99 |
| 0 | 3 | 15.0 | 56.3 | 14.0 | 99 |
| 0 | 5 | 15.0 | 54.2 | 13.8 | 99 |
| 0 | 10 | 15.0 | 49.2 | 9.5 | 99 |
| 0.04 | 0.05 | 15.0 | 55.4 | 14.0 | 99 |
| 0.02 | 0.1 | 15.0 | 56.0 | 14.0 | 99 |

METHOD OF MANUFACTURING ORIENTED BODY, MOLDED BODY AND SINTERED BODY AS WELL AS METHOD OF MANUFACTURING PERMANENT MAGNET

This application is a national phase entry under 35 U.S.C. §371 of PCT Patent Application No. PCT/JP2007/072392, filed on Nov. 19, 2007, which claims priority under 35 U.S.C. §119 to Japanese Patent Application Nos. 2006-313827, filed Nov. 21, 2006, and 2007-003400, filed Jan. 11, 2007, all of which are incorporated by reference.

FIELD OF THE INVENTION

The present invention relates to a method of manufacturing an oriented (or orientated) body a molded body and a sintered body as well as a method of manufacturing a permanent magnet, and relates in particular to a method to be used in manufacturing a Nd—Fe—B system permanent magnet.

BACKGROUND ART

Permanent magnets, particularly Nd—Fe—B sintered magnets (so-called neodymium magnet) are made of a combination of iron with elements of Nd and B that are low-priced and abundant as natural resources and also capable of stable supply and, thus, can be manufactured at a low cost and, at the same time, have high magnetic properties (maximum energy product is about 10 times that of ferritic magnets). Therefore, they are used in various kinds of electronic products and are recently widely used in motors and generators for hybrid cars.

As an example of manufacturing Nd—Fe—B sintered magnets, there is known a powder metallurgy method. In this method, Nd, Fe and B are first mixed in a predetermined composition ratio, dissolved, and molded to manufacture an alloy raw material. It is once coarsely crushed by, e.g., hydrogen crushing step, and is subsequently finely ground by, e.g., jet mill fine grinding step, thereby obtaining an alloy raw meal powder. Then, the obtained alloy raw meal powder is subjected to orientation in the magnetic field (magnetic field orientation), and is compression-molded while being charged with magnetic field, thereby obtaining a molded body. Then, the molded body is sintered under predetermined conditions to thereby manufacture a sintered magnet.

As a method of compression molding in the magnetic field, there is generally used a uniaxial pressurizing type of compression molding machine. In this compression molding machine, alloy raw meal powder is filled into a cavity formed in a penetrating hole in a die, and is pressurized (pressed) by a pair of upper and lower punches from the upper and lower directions to thereby form a product out of the alloy raw meal powder. There has been a problem in that, at the time of compression molding by means of the pair of punches, high orientation cannot be obtained and that the magnetic properties cannot be improved due to friction among the particles of the alloy raw meal powder filled in the cavity or due to friction between the alloy raw meal powder and the wall surface of the mold set in position in the punch.

In view of the above, there is known another compression molding method in which, after having filled a cavity with alloy raw meal powder, at least one of punches of an upper punch and a lower punch is vibrated in the direction of pressurizing (pressing direction) at the time of magnetic field orientation. This compression molding method is performed in the following manner, i.e., by charging magnetic field while alloy raw meal powder is vibrated by the upper punch or the lower punch, the friction among the particles in the alloy raw meal powder filled in the cavity is changed from the static friction to the dynamic friction. The friction among the particles of the alloy raw meal powder is thus reduced with a consequent improvement in the flowability of the alloy raw meal powder. Since the raw meal powder can thus be moved so as to be arrayed in the direction of magnetic field orientation, the orientation can be improved (see patent document 1). Patent Document 1: International Publication No. 2002-60677, see e.g., claims)

DISCLOSURE OF THE INVENTION

Problems to be Solved by the Invention

However, in the above-described compression molding method, since vibration is caused to take place only by one of the upper punch and the lower punches at the time of magnetic field orientation, the positional relationship among the particles of the alloy raw meal powder within the cavity hardly changes from the state in which it was initially filled into the cavity. As a result, in case the crystal fractures of the adjoining particles in the orientation direction of the magnetic field do not match with each other (since alloy raw meal powder of Nd—Fe—B sintered magnet is manufactured by mixing Nd, Fe and B and fusing and alloying and thereafter grinding them, the surface of the alloy raw meal powder has formed therein crystal fractures), clearance will remain, in the end, among the particles of the alloy raw meal powder and, therefore, the easy axis of magnetization of the alloy raw meal powder will not be in order. If compression molding is executed in this state, there is a problem in that the orientation will get out of order.

In view of the above points, this invention has an object of providing a method of manufacturing an oriented body molded body and a sintered body that is capable of manufacturing an oriented body a molded body and a sintered body having an extremely high orientation, by combining together in the magnetic field or electric field the powder crystal fractures having more equal crystal orientational relationship. It also has an object of providing a method of manufacturing a permanent magnet.

Means for Solving the Problems

In order to solve the above problems, the method of manufacturing an oriented body according to claim 1 comprises filling a filling chamber with powder that is polarized in magnetic field or electric field; and orienting, while agitating, the powder in magnetic field or electric field.

According to this invention, since the powder in the filling chamber is agitated in the magnetic field or electric field at the time of orienting the powder in the magnetic field or the electric field, the positional relationship among the particles of the powder in the filling chamber will be changed from the state in which the particles were initially filled into the filling chamber. As a result, there will be more chances in which, among the combinations of crystal fractures in orienting in the magnetic field or electric field, the crystal fractures having more equal crystal orientational relationship get bonded. Once the crystal fractures having equal crystal orientational relationship are bonded, there will be formed firm bonding chains and, as a result, the crystal fractures get combined and arrayed without clearance in the magnetic field orientation. An oriented body having a high orientation can thus be obtained.

In addition, in order to solve the above problems, the method of manufacturing a molded body according to claim 2 comprises: a first step of filling a filling chamber with powder that is polarized in magnetic field or electric field and orienting in the magnetic field or electric field, while agitating, the powder in the filling chamber; and a second step of compression molding the powder oriented in the first step in the magnetic field or electric field.

According to this invention, by agitation in the magnetic field or electric field, the powder can be compression-molded in a state in which the crystal fractures having the equal crystal orientational relationship get bonded together. Therefore, there can be obtained a molded body having a high orientation. Further, since the crystal fractures having the equal crystal orientational relationship get firmly bonded together, there can be obtained a high-density molded body at a low molding pressure. The strength of the molded body becomes stronger and the rate of occurrence of unacceptable quality can be lowered.

Further, in order to solve the above problems, the method of manufacturing a sintered body according to claim 3 comprises: a first step of filling a filling chamber with powder that is polarized in magnetic field or electric field and orienting, while agitating, the powder in the filling chamber; a second step of compression molding, in magnetic field or electric field, the powder oriented in the first step; and a third step, in addition to or in place of the second step, of sintering the oriented body or compression-molded body.

According to this invention, due to agitation in the magnetic field or electric field, the molded body obtained, e.g., in the second step has been compression-molded in a state in which the fluctuations in the powder density have been reduced. Therefore, when this molded body is sintered, the fluctuation in the amount of shrinkage can be reduced.

Furthermore, in order to solve the above problems, the method of manufacturing a permanent magnet according to claim 4 comprises: an orienting step of filling a filling chamber with alloy raw meal powder and orienting, while agitating, the alloy raw meal powder in the filling chamber in magnetic field; and a molding step of compression molding the alloy raw meal powder oriented in the orienting step to a predetermined shape in magnetic field.

According to this invention, when the alloy raw meal powder is oriented in the magnetic field, the alloy raw meal powder is agitated inside the filling chamber while charging the magnetic field. Therefore, the positional relationship among the particles of the alloy raw meal powder within the filling chamber will be changed from the state in which it was initially filled into the filling chamber. There will thus be more chances in which the crystal fractures of the alloy raw meal powder having more equal crystal orientational relationship will get bonded together. Once the crystal fractures having equal crystal orientational relationship are bonded, a firm bonding chain will be formed. The crystal fractures will be combined without clearance in the direction of magnetic orientation in a manner to form a bar shape. By compressing the alloy raw meal powder in this state, there can be formed a high-density molded body (permanent magnet) that is free from disturbance in orientation, whereby a permanent magnet having high magnetic properties can thus be obtained.

In the invention according to claim 4, the alloy raw meal powder shall preferably be filled into the filling chamber after having mixed a lubricant to the alloy raw meal powder in a predetermined mixing ratio. According to this operation, when the alloy raw meal powder is oriented in the magnetic field, by agitating the alloy raw meal powder in the filling chamber while charging the magnetic field, the positional relationship among the particles of the alloy raw meal powder inside the filling chamber changes from the state in which it was initially filled into the filling chamber. Further, by adding the lubricant to the alloy raw meal powder, the flowability of the alloy raw meal powder is improved. As a result of these combined effects, the chances of combining the crystal fractures of the alloy raw meal powder having more equal crystal orientational relationship are advantageously increased.

The molding step may be is executed by a uniaxial pressurizing type of compression molding machine, and the compression molding pressure may be set to a range of 0.1 $t/cm^2$~1 $t/cm^2$. If the molding pressure is less than 0.1 $t/cm^2$, the molded body will not have a sufficient strength. For example, when the molded body is pulled out of the cavity of the compression molding machine, it will be cracked. On the other hand, if the molding pressure is above 1 $t/cm^2$, a high molding pressure will be applied to the alloy raw meal powder inside the cavity. As a result, the molding will be made while disturbing the orientation and also the molded body will be subjected to cracking and split.

In this case, the method preferably further comprises a second molding step in which the molded body obtained in the first molding step is molded in isostatic molding. Then, the density of the molded body will further be increased. The occurrence of cracks and splits (fissures) can advantageously be reduced.

On the other hand, the molding step may be executed by an isostatic molding machine, and a compression molding pressure may be set to a range of 0.3 $t/cm^2$~3.0 $t/cm^2$. At a compression molding pressure below 0.3 $t/cm^2$, the molded body will not have a sufficient strength and is likely to give rise to cracks and fissures. On the other hand, at a molding pressure above 3.0 $t/cm^2$, the sealed parts of the apparatus will be damaged, which is not practical.

If the method further comprises a sintering step, in addition to or in place of the molding step, of sintering the oriented body or compression-molded body a sintered magnet (permanent magnet) of higher orientation and magnetic properties can advantageously be obtained.

In case the solid lubricant is used as the above-described lubricant, the mixing ratio shall preferably be set to a range of 0.02 wt %~0.1 wt %. At a mixing ratio below 0.02 wt %, the flowability of the alloy raw meal powder will not be improved. As a result, there is a possibility that the orientation cannot be improved. On the other hand, at a mixing ratio above 0.1 wt %, when the oriented body or the molded body is sintered, the coercive force of the permanent magnet will be lowered under the influence of the carbon that remains inside thereof.

On the other hand, in case a solid lubricant is used as the lubricant, the mixing ratio shall preferably be set to a range of 0.05 wt %~5 wt %. At a mixing ratio below 0.05 wt %, the flowability of the alloy raw meal powder is not improved and, consequently there is a possibility that the orientation cannot be improved. On the other hand, at a mixing ratio above 5 wt %, when the oriented body or the molded body is sintered, the coercive force of the permanent magnet will be lowered under the influence of the carbon that remains inside thereof.

Further, as the lubricant, preferably a mixture in a predetermined mixing ratio of a solid lubricant and a liquid lubricant is used. The lubricant will then be spread to every corner of the alloy raw meal powder. As a result of high lubricating effect, a higher orientation can be obtained so as to make a permanent magnet of high magnetic properties.

If the alloy raw meal powder is for a rare earth magnet manufactured by a quenching process, the alloy raw meal powder will become of an angular particle shape, the area of the crystal fractures can be made large, and the clearance among the particles of the alloy raw meal powder can be made small. As a result of combined effect in that there are many chances of combining the crystal fractures of the alloy raw meal powder having more equal crystal orientational relationship, the orientation can extremely be made high.

Preferably the agitation of the alloy raw meal powder is executed with an agitating means made of a non-magnetic material. According to this arrangement, at the time of agitating the alloy raw meal powder in the magnetic field, the alloy raw meal powder can be prevented from getting adhered to the agitating means, thereby preventing the alloy raw meal powder from getting insufficiently agitated.

Preferably at least one of the orienting step and the molding step is executed in static magnetic field, and the intensity of the magnetic field is set to a range of 5~30 kOe. At the intensity of magnetic field below 5 kOe, the product of high orientation and high magnetic properties cannot be obtained. On the other hand, at the intensity of magnetic field above 30 kOe, the magnetic field generating apparatus becomes too large, which is not practical.

On the other hand, preferably at least one of the orienting step and the molding step is executed in magnetic pulse field, and the intensity of the magnetic field is set to a range of 5~50 kOe. According to this configuration, at the time of agitating and molding of the alloy magnetic powder, the alloy raw meal powder itself is subjected to vibrations, thereby resulting in an improvement in the orientation. However, if the intensity of the magnetic field is below 5 kOe, a product of high orientation and high magnetic properties cannot be obtained. On the other hand, if the intensity of the magnetic field is above 50 kOe, the magnetic field generating apparatus becomes too large, which is not practical.

Effect of the Invention

As described hereinabove, this invention has an effect in that there can be obtained an oriented body a molded body a sintered body and a permanent magnet having an extremely high orientation and in which the crystal fractures of the powder having equal crystal orientational relationship are closely bonded without clearance.

BEST MODE FOR CARRYING OUT THE INVENTION

With reference to FIGS. 1 through 5, reference numeral 1 denotes a compression molding machine which is suitable for manufacturing rare earth permanent magnet of this invention, in particular, Nd—Fe—B sintered magnet (inclusive of oriented body and molded body). The compression molding machine 1 is of a uniaxial type in which the direction of pressurizing (pressing direction) is vertical to the direction of magnetic orientation, and has a base plate 12 which is supported by leg pieces 11. Above the base plate 12 there is disposed a die 2. The die 2 is supported by a plurality of supporting columns 13 which penetrate through the base plate 12. The other end of each of the supporting columns 13 is connected to a connecting plate 14 disposed below the base plate 12. The connecting plate 14 is connected to a driving means, e.g., a cylinder rod 15 of a hydraulic cylinder of a known construction. According to this configuration, when the lower hydraulic cylinder is actuated to move up and down the connection plate 14, the die 2 is movable in an up-and-down direction (pressurizing direction Y).

In substantially the central part of the die 2, there is formed a penetrating hole 21 in the up-and-down direction. Into the penetrating hole 21 there can be inserted a lower punch 31 which is vertically disposed on substantially the central part of the upper surface of the base plate 12. When the lower hydraulic cylinder is actuated to lower the die 2, the lower punch 31 is inserted into the penetrating hole 21 to thereby define a cavity (filling chamber) 22 inside the penetrating hole 21. Relative to the cavity 22 a powder feeding apparatus (not illustrated) of the known construction is movable back and forth. By means of this powder feeding apparatus there can be filled an alloy raw meal powder metered in advance into the cavity 22.

On an upper part of the die 2 there is disposed a die base 16 which lies opposite to the base plate 12. On a lower surface of the die base 16 there is provided an upper punch 32 in a position capable of insertion into the cavity 22. Further, at the corner portions of the die base 16 there are formed penetrating holes in the vertical direction. In each of the penetrating holes there is inserted a guide rod 17 one end of which is fixed to the upper surface of the die 2. To the upper surface of the die base 16 there is connected a driving means, e.g., a cylinder rod 18 of a hydraulic cylinder (not illustrated) of a known construction. When this hydraulic cylinder is actuated, the die base 16 becomes moveable up and down guided by the guide rods 17 and consequently the upper punch 32 becomes movable in the vertical direction (pressurizing direction) so that the upper punch 32 can be inserted into the penetrating hole 21 of the vertically movable die 2. According to this configuration, at the time of compression molding, the alloy raw meal powder P will be compressed by the pair of the upper and lower punches 31, 32 within the cavity 22, whereby a molded body can be obtained (molding step).

In addition, on a periphery of the die 2 there is provided a magnetic field generating apparatus 4 in order to orient in the magnetic field the an alloy raw meal powder P inside the cavity 22. The magnetic field generating apparatus 4 is disposed in a symmetrical manner so as to sandwich the die 2 from both sides, and has a pair of yokes 41*a*, 41*b* made of a material that is high in magnetic permeability such as carbon steel, mild steel, pure iron, permendur, and the like. Both the yokes 41*a*, 41*b* have wound thereabout coils 42*a*, 42*b* and, by charging each of the coils 42*a*, 42*b* with electric power, there will be generated static magnetic field in a direction X perpendicular to the pressurizing direction (up-and-down direction Y). According to this configuration, the alloy raw meal powder P filled in the cavity 22 can be oriented.

The alloy raw meal powder P is manufactured in the following manner. In other words, Fe, B, and Nd are blended in a predetermined composition ratio, and an alloy of 0.05 mm~0.5 mm is first manufactured by a quenching process, e.g., by a strip cast method. On the other hand, an alloy of about 5 mm thick may also be manufactured by a centrifugal casting method, or else a small amount of Cu, Zr, Dy, Al or Ga may be added at the time of blending. Then, the manufactured alloy is coarsely crushed by a known hydrogen crushing step and is subsequently finely ground by a jet mill fine crushing step in nitrogen gas atmosphere, thereby obtaining alloy raw meal powder of an average particle size of 2~10 μm. In this case, if the quenching process is used, the alloy raw meal powder P becomes angular particle shape, each crystal fracture area can be made large, and the clearance among the particles of the alloy raw meal powder P can be made small.

Now, after filling the cavity 22 formed in the penetrating hole 21 in the die 2 with the alloy raw meal powder P that was manufactured as described above, the alloy raw meal powder P is pressurized in the upper and lower directions by the pair of upper and lower punches 31, 32 to thereby mold under pressure the alloy raw meal powder P. At this time, it is necessary to make an arrangement so as to obtain a high orientation, thereby improving the magnetic properties. In this embodiment, in order to improve the flowability of the alloy raw meal powder P, a lubricant is added in a predetermined mixing ratio to the alloy raw meal powder P. The particle surfaces of the alloy raw meal powder P are thus arranged to be coated with this lubricant.

As the lubricant, solid lubricants or liquid lubricants having a low viscosity are used so that they do not damage the metal mold. As the solid lubricants, there can be listed lamellar compounds ($MoS_2$, $WS_2$, MoSe, graphite, BN, CFx, and the like), soft metal (Zn, Pb, and the like), rigid materials (diamond powder, TiN powder, and the like), organic high polymers (PTEE series, aliphatic nylon series, higher aliphatic series, fatty acid amide series, fatty acid ester series, metallic soap series, and the like). It is particularly preferable to use zinc stearate, ethylene amide, and grease of fluoroether series.

On the other hand, as the liquid lubricant, there can be listed natural grease material (vegetable oils such as castor oil, coconut oil, palm oil, and the like; mineral oils; petroleum grease; and the like), and organic low molecular materials (low-grade aliphatic series, low-grade fatty acid amide series, low-grade fatty acid ester series). It is particularly preferable to use liquid fatty acid, liquid fatty acid ester, and liquid fluorine lubricant. Liquid lubricants are used with surfactant or by diluting with solvent. The carbon residue content of the lubricants that remains after sintering lowers the coercive force of the magnet. Therefore, it is preferable to use low molecular weight materials to facilitate the removal in the sintering step.

In case a solid lubricant is added to the alloy raw meal powder P, addition may be made in a mixing ratio of 0.02 wt %~0.1 wt %. If the mixing ratio is less than 0.02 wt %, the flowability of the alloy raw meal powder P will not be improved and, consequently the orientation will not be improved. On the other hand, if the mixing ration exceeds 0.1 wt %, the coercive force lowers under the influence of the carbon residue content that remains in the sintered magnet when the sintered magnet is obtained. Further, in case a liquid lubricant is added to the alloy raw meal powder P, it may be added in a range of 0.05 wt %~5 wt %. If the mixing ratio is less than 0.05 wt %, the flowability of the alloy raw meal powder P will not be improved and, consequently there is a possibility that the orientation will not be improved. On the other hand, if the mixing ration exceeds 5 wt %, the coercive force lowers under the influence of the carbon residue content that remains in the sintered magnet when the sintered magnet is obtained. By the way as the lubricants, if both the solid lubricant and the liquid lubricant are added, the lubricants will be widely spread to every corner of the alloy raw meal powder P and, due to high lubricating effect, a higher orientation can be obtained.

In this embodiment, there was provided the mixing apparatus 5 that is movable into, and out of, the cavity 22. After having filled the cavity 22 as the filling chamber with the alloy raw meal powder P, prior to the compression molding (molding step) with the pair of upper and lower punches 31, 32, the alloy raw meal powder P in the cavity 22 was arranged to be oriented, while agitating, in the magnetic field in a state in which each of the coils 42*a*, 42*b* of the magnetic field generating apparatus 4 is electrically charged (in the magnetic field), thereby generating the static magnetic field (orienting step).

The agitating apparatus 5 has a supporting plate 51 provided on an upper surface of the die 2 in parallel therewith. The upper surface of the supporting plate 51 is provided with a hydraulic cylinder 52 of a known construction. A pneumatically driven type of motor 53 of a known construction is mounted on a cylinder rod 52*a* that is projected to the lower side of the supporting plate 51. A rotary vane 54 is mounted (rotary agitation) on the motor 53 at a rotary shaft 53*a* that is disposed at a position on a longitudinal axial line of the cylinder rod 52*a*. The rotary shaft 53*a* and the rotary vane 54 constitute the agitating means. The rotary vane 54 is of a screw vane type (propeller vane). The rotary shaft 53*a* and the rotary vane 54 are made of a non-magnetic material such as 18-8 stainless steel. By making the rotary shaft 53*a* and the rotary vane 54 in a non-magnetic material, at the time of agitating the alloy raw meal powder in the magnetic field, the alloy raw meal powder P can be prevented from getting adhered to the agitating means, the adhesion causing insufficient agitation of the alloy raw meal powder P and consequent disturbance in the magnetic field.

The supporting plate 51 is mounted on two guide rails 55 elongated in a direction perpendicular to the vertical direction Y. By sliding the supporting plate 51 along the guide rails 55, the agitating apparatus 5 becomes capable of moving back and forth relative to the cavity 22. In this case, the powder feeding apparatus may also be mounted on the same guide rails 55 so as to be freely moveable back and forth relative to the cavity 22. Once the agitating apparatus stops at a stopper (not illustrated) provided on the guide rails 55, the rotary shaft 53*a* is positioned so as to be located on the longitudinal axis of the pair of the upper and lower punches 31, 32. A lid plate 56 made of a non-magnetic material is mounted on the rotary shaft 53*a* of the motor 53. Once the cylinder 52 is actuated to thereby lower the rotary vane 54 to a predetermined position inside the cavity 22, the lid plate 56 comes into abutment with the upper surface of the die 2 to thereby close the upper part of the penetrating hole 21. The lid plate 56 thus performs the function of preventing the alloy raw meal powder P from jumping out to the outside of the cavity 22 during agitation.

According to this configuration, when the alloy raw meal powder P is oriented in the magnetic field, the flowability of the alloy raw meal powder is improved by adding the lubricant to the alloy raw meal powder P, and the alloy raw meal powder P that is filled into the cavity 22 and is high in flowability is agitated while charging the alloy raw meal powder with the magnetic field. As a result of the above, the positional relationship inside the cavity 22 among the particles of the alloy raw meal powder P can be changed from the state at which it was initially filled into the cavity 22. In combination therewith, as a combined effect, the chances of combining the crystal fractures of the alloy raw meal powder P having more equal crystal orientational relationship increase. Once the crystal fractures having the same crystal orientational relationship get combined, strong bonding chains are formed, and the crystal fractures get joined together without clearance in the direction of magnetic orientation. By executing compression molding in this state, there can be obtained a high-density molded body M (see FIG. 5) without disturbance in the orientation. As a result of increase in the strength of the molded body the rate of occurrence of unacceptable products can be lowered and a molded body M (permanent magnet) of high magnetic properties can be obtained. In this case, if a resin binder is mixed with the alloy raw meal powder P to be filled into the cavity 22, rare earth bonded magnet (molded body) of high magnetic properties can be obtained.

Then, with reference to FIGS. 1 through 5, a description will be made of the manufacturing of Nd—Fe—B (Nd—Fe—B system) sintered magnet. First, from a waiting position in which each of the upper surfaces of the die 2 and the lower punch 31 are flush with each other and in which the upper punch 32 is positioned at the upper end (see FIG. 1), the hydraulic cylinder is actuated to raise the die 2 to a predetermined position so that a cavity is defined inside the penetrating hole 21. Then, by the powder feeding apparatus (not illustrated), the alloy raw meal powder P that has been weighed in advance and to which a lubricant has been mixed in a predetermined mixing ratio is filled into the cavity 22, and the powder feeding apparatus is retreated. In this case, the charging density of the alloy raw meal powder P in the cavity 22 is set to be 2.2~3.9 g/cc in order to prevent the alloy raw meal powder P from getting unbalanced or in order to leave freedom to move at the time of agitation (see FIG. 2).

Then, the agitating apparatus 5 is moved so that the rotary shaft 53*a* of the motor 53 is positioned on the longitudinal axis of the pair of upper and lower punches 31, 32 (see FIG. 2). Then, the motor 53 and the lid plate 56 are lowered through the hydraulic cylinder 52. The lid plate 56 thus comes into abutment with the upper surface of the die 2, thereby blocking the upper surface of the penetrating hole 21. At the same time, the rotary vane 54 is buried in the alloy raw meal powder P filled into the cavity 22 (see FIG. 3). In this state, the coils 42*a*, 42*b* of the magnetic field generating apparatus 4 are charged with electric power and, in the magnetic field, the motor 53 is actuated to rotate the rotary vane 54 in the cavity 22 (orienting step). In this case, in order to obtain a high orientation, it is preferable to agitate with the agitating apparatus 5 in the magnetic field of a range of 5 kOe~30 kOe, preferably 10 kOe~26 kOe. If the magnetic field intensity is weaker than 5 kOe or stronger than 30 kOe, a sintered magnet of high orientation and high magnetic properties cannot be obtained. In addition, in order for the alloy raw meal powder P filled into the cavity 22 to be mixed in its entirety the number of rotation of the rotary vane 54 is set to 100~50000 rpm, preferably to 4000 rpm, and the rotary vane is actuated for a predetermined period of time (1~5 seconds).

According to this configuration, even if the upper punch or the lower punch is subjected to vibrations as in the conventional method, in case the crystal fracture of the raw meal powder particles P that lie next to one another in the direction of magnetic field do not meet each other, there will remain clearance among the alloy raw meal powder particles P. This results in failure to array the alloy raw meal powder particles P in the direction of the magnetic field orientation. If the compression molding is performed in this state, the orientation gets disturbed. Like in the embodiment, on the other hand, by orienting while agitating the alloy raw meal powder P in a state in which the magnetic field is charged thereto, the positional relationship among the particles of the alloy raw meal powder P within the cavity 22 will vary from the state in which the alloy raw meal powder was filled into the cavity 22. There will thus be many chances for the crystal fractures of the alloy raw meal powder P that has more equal crystal orientational relationship to be combined. Once the crystal fractures having equal crystal orientational relationship get bonded with one another, there will be formed a strong bonding chain. As shown in FIG. 4(*b*), the crystal fractures get joined without clearance in the direction of magnetic orientation in a manner to form a bar-shape, thereby arraying in the direction of orientation of the magnetic field.

Then, once the agitation of the alloy raw meal powder P in the magnetic field has been finished, the cylinder rod 52*a* is lifted to the position in which the rotary vane 54 is away upward of the die 2, and thereafter the agitating apparatus 5 is slid along the guide rails 55 to thereby retract it. In this case, the electric charging to the coils 42*a*, 42*b* will not be stopped. Then, the die base 16 is lowered to insert the upper punch 32 from the upper side into the penetrating hole 21. In a state in which the magnetic field is charged, compression molding of the alloy raw meal powder P inside the cavity 22 is started by the pair of the upper and lower punches 31, 32. After a lapse of a predetermined time, the electric charging to the coils 42*a*, 42*b* is stopped and, in this state, compression molding at the maximum pressure will be executed. Finally the upper punch 32 is gradually lifted to thereby gradually reduce the pressure. The compression molding is finished and the molded body M is formed (molding step). According to the above operations, compression molding is performed in a state in which the alloy raw meal powder is joined in a direction of magnetic field orientation just like molding a bar shape without clearance among the crystal fractures so as to be in an array in the magnetic field orientation. Therefore, there can be obtained a high-density molded body M (permanent magnet) without disturbance in the orientation, and the magnetic properties are also improved.

The molding pressure in the molding step is set to a range of 0.1~1 t/cm$^2$, more preferably to 0.2~0.7 t/cm$^2$. At the molding pressure, for example, below 0.1 t/cm$^2$ the molded body does not have a sufficient strength. For example, it gives rise to cracks when the molded body is taken out of the cavity 22 of the molding apparatus. On the other hand, at a molding pressure exceeding 1 t/cm$^2$ a high pressure is exerted on the alloy raw meal powder P inside the cavity 22 and, as a result, molding is made while orientation is struck out of shape and also there is a possibility that the molded body gives rise to cracks and splits. In addition, the intensity of the magnetic field in the molding step is set to a range of 5 kOe~30 kOe. If the intensity of the magnetic field is weaker than 5 kOe, there cannot be obtained a product high in orientation and high in magnetic properties. On the other hand, if the intensity of the magnetic field is stronger than 50 kOe, the magnetic field generating apparatus becomes too large to be practical.

Subsequently after having demagnetization by charging reverse magnetic field of, e.g., 3 kOe, the die 2 is lowered to the lower end. The molded body M inside the cavity 22 will then be pulled out to the upper surface of the molding die 16. The die base 16 is moved to thereby move the upper punch 32 to the upper end, and then the molded body is taken out. Finally the obtained molded body is contained in a sintering furnace (not illustrated) to execute sintering for a predetermined period of time at a predetermined temperature (1000° C.) in, e.g., argon atmosphere (sintering step). Further, aging treatment is executed in argon atmosphere for a predetermined period of time at a predetermined temperature (500° C.), thereby obtaining a sintered magnet (Nd—Fe—B sintered magnet).

In this embodiment, a description has been made of a uniaxial pressurizing system in which the molding direction is perpendicular to the direction of magnetic field. Without being limited thereto, there may be used a molding apparatus in which the molding direction is in parallel with the direction of the magnetic field. In addition, in this embodiment, as the orientation magnetic field at the time of agitation and molding, there was used a static magnetic field in which the intensity per unit time of the magnetic field does not change. Without being limited thereto, there may be used, as shown in FIG. 6, a magnetic pulse field in which the intensity of magnetic field per unit time varies at a predetermined cycle. In this case, as shown in FIG. 7, it may be so arranged that reverse magnetic field is charged. According to this configuration, since vibrations can be applied to the alloy raw meal powder P at the time of agitation and molding of the alloy raw meals powder P whose flowability has been improved by the addition of lubricants, the orientation can further be improved. In this case, the period of pulse is preferably 1 ms~2 s and the non-output time shall preferably be set to below 500 ms. If this range is exceeded, strong bonding chains will be broken, with the result that a high orientation cannot be obtained. In addition, in case the magnetic pulse field is charged, the peak value shall preferably be set to 5~50 kOe. If the magnetic field intensity is weaker than 5 kOe, there cannot be obtained a product high in orientation and high in magnetic properties. On the other hand, if the magnetic field is stronger than 50 kOe, the magnetic field generating apparatus becomes too large and the durability of the apparatus becomes low and is therefore not practical.

In the embodiment, a description has been made of an example in which a rotary vane 54 of screw vane type is used as the agitating means (rotary agitation). However, without being limited thereto, there may be used one in which a rectangular scoop (not illustrated) provided with a driving means such as a pneumatic cylinder is attached to a front end of the cylinder rod 52*a* of the hydraulic cylinder 52 so as, in a state in which the scoop is buried into the alloy raw meal powder P, to reciprocate the scoop horizontally over the entire length in the radial direction of the cavity 22 at a predetermined cycle (horizontal agitation). In this case, at the time of rotary agitation or horizontal agitation, the cylinder rod 52*a* may be moved up and down so as to mix the whole of the alloy raw meal powder P in the cavity 22.

Regarding the rotary vane 54 in the case of rotary agitation, as long as mixing can be made, during agitation, so as to mix the whole of the alloy raw meal powder P in the cavity 22, there is no particular limitation. It may be of the type to generate air flow, but preferably it shall be of a shape that hardly crushes the alloy raw meal powder during agitation. As shown in FIG. 8, as the rotary vane, there may be employed: a paddle vane type in which substantially L-shaped plate pieces 54*a* are provided on the rotary shaft while deviating by 90 degrees (see FIG. 8(*a*)); a ribbon vane type in which vanes 54*b* are provided spirally (see FIG. 8(*b*)); and an anchor vane type in which plate pieces 54*c* are provided so as to extend horizontally relative to the rotary shaft (see FIG. 8(*c*)). Depending on the selected rotary vanes, the number of rotation and time of agitation are appropriately set. On the other hand, not only the rotary agitation and horizontal agitation as the agitation means, there may be employed one in which a gas nozzle is provided at the front end of the cylinder rod 52*a* to thereby constitute an agitating means made of a non-magnetic material. A high-pressure gas may thus be intermittently or continuously ejected so as to agitate the alloy raw meal powder P in the cavity 22.

In the embodiment, a description has been made of an example in which a uniaxial pressurizing type of compression molding machine 1 is used to mold the powder. An isostatic molding machine (not illustrated) of a known construction using a rubber mold may be employed. In this case, this rubber mold is filled with alloy raw meal powder P, and then an orienting step is performed to agitate in the magnetic field by the agitating apparatus 5. On the other hand, there may be performed a second molding step in which the molded body M obtained by the molding step in the uniaxial pressurizing type of compression molding machine 1 is further molded by using the isostatic molding machine. According to this configuration, the occurrence of cracks and splits in the molded product can be reduced.

Further, in the embodiment, the compression molding machine 1 was used to manufacture an oriented body by orienting in the magnetic field while agitating the alloy raw meal powder P in the magnetic field. Subsequently compression molding was executed in a state of charging the magnetic field. However, the following way may be employed. That is, the alloy raw meal powder that has been obtained in the above procedure is filled into a box body of Mo make having an upper opening and is subjected to agitation by the above-described agitating apparatus 5 for a predetermined period of time in a static magnetic field. Thereafter, the agitating apparatus 5 is retracted and, without demagnetizing, a lid of Mo make is mounted on the upper opening of the box body. Thereafter, the magnetic field is attenuated and subsequently the box body with the lid mounted is placed as it is into a sintering furnace for sintering to obtain a permanent magnet (sintered body). In this case, the intensity of the magnetic field is set to 12 kOe, and the box body is formed into a cube of 7 cm. And a sintered body was obtained by setting the number of rotation of the agitating apparatus 5 to 40000 rpm and the time of agitation to 2 seconds. As a result, average magnetic properties of Br=15.01 kG, (BH) max=55.1 MG Oe and the degree of orientation of 99% were obtained.

Further, in the embodiment, although a description has been made of manufacturing of the sintered magnet, this method of manufacturing an oriented body a molded body and a sintered body can be applied to: manufacturing an oriented body by orienting powder polarized in the magnetic field or electric field; compressing the oriented body in the magnetic field or electric field; or, in addition to or in place of the compression molding, sintering the body oriented in the magnetic field or electric field or compression molded. For example, this art may be applied to the manufacturing of a sintered body of silicon nitride ($Si_3N_4$) by molding a predetermined powder in the magnetic field and then sintering it.

Example 1

In Example 1, Nd—Fe—B alloy raw meal powder was manufactured as described below, an orienting step and a molding step were executed by using a below-described molding apparatus to thereby manufacture a predetermined molded body and, thereafter, a sintering step was executed in which the molded body was sintered in argon atmosphere at a temperature of 1050° C. for 4 hours, thereby obtaining a Nd—Fe—B sintered magnet.

(Alloy Raw Meal Powder) As Nd—Fe—B sintered magnet, material having a composition of 25Nd-3Pr-1Dy-0.95B-1Co-0.2Al-0.05Cu-0.01Ga-0.05 Mo-bal.Fe was used to manufacture an alloy raw material by vacuum fusion and molding. The alloy raw material was once subjected to coarse grinding by, e.g., hydrogen crushing step and then was subjected to fine grinding by, e.g., jet mill fine grinding step to thereby obtain an alloy raw meal powder. As the molding conditions, i) after having vacuum-melted the above alloy it was molded into a water-cooled cupper book mold (box type mold) of 10 mm thick (book mold), ii) after vacuum-melting, the above-described alloy was molded on a water-cooled rotating cupper roll and was manufactured into a foil band (strip) of 0.1 mm~0.5 mm (strip casting), or iii) after the vacuum-melting of the above-described alloy, an ingot of 30 mm thick was manufactured by centrifugal casting (centrifugal casting method). To the alloy raw meal powder P thus manufactured there was appropriately added a solid lubricant containing stearic acid and cobalt stearate, or a liquid lubricant made of fluorine lubricant at a mixing ratio of 0.2 wt %.

(Molding Step) (i) As the molding step the uniaxial compression molding machine 1 as shown in FIG. 1 was used. The compression molding machine 1 is constituted so as to be able to generate the static magnetic field of maximum 16 kOe in the cavity 22 having a square opening of 7 cm. Alloy raw meal powder P was filled in the cavity 22 in an inert gas atmosphere. Then, while charging the static magnetic field of 16 kOe, agitation was executed by the agitating apparatus as described below for a predetermined period of time (orienting step). Thereafter, in a state in which the magnetic field was being charged, compression step was executed by the pair of upper and lower punches 31, 32 (molding step). The molding pressure in this case was set to 0.5 t/cm$^2$. After compression molding, reverse magnetic field of 3 kOe was charged for demagnetization, and thereafter the molded body was taken out of the cavity 22.

(ii) As the molding step rubber mold for isostatic molding apparatus having a square cavity of 7 cm was filled with alloy raw meal powder P. While charging the static magnetic field of 12 kOe, agitation was executed by the below-descried agitating means for a predetermined period of time. Thereafter, the agitating means 5 was retracted, and the rubber mold was capped with a lid, and was transported to an isostatic molding apparatus (not illustrated) for further molding at isostatic pressure of 1 t/cm$^2$.

(Agitating Means) (i) As the agitating means, there was used one as shown in FIG. 1 having mounted thereon a screw type of rotary vane 54. The rotary shaft 53*a* of the motor 53 and the rotary vane 54 were made of 18-8 stainless steel. After moving the agitating apparatus 5 to a predetermined position, it rotated at the number of rotation of 4000 rpm for 2 seconds. (ii) A rectangular scoop of 18-8 stainless steel make was mounted on a hydraulically driven reciprocating actuator (not illustrated) and was reciprocated for 2 seconds at a reciprocating speed of 10 times per second and 40 mm stroke. As a comparative example, agitation was also executed by one in which the rotary vane 54 and scoop were made of a magnetic material of carbon steel.

FIG. 9 is a table showing magnetic properties and orientation when sintered magnets were obtained by changing the casting conditions, molding step conditions, and agitating conditions of the alloy raw meal powder. The magnetic properties are average values as a result of evaluation by a BH tracer. The orientation is a value obtained by dividing the remanent flux density by saturation flux density at 10 T. According to this, it can be seen: that a high orientation can be obtained if, prior to the molding step, orientation is executed while agitating in the magnetic field; and that, at that time, the orientation can be increased when a non-magnetic material is used. In this case, if alloy raw meal powder manufactured by the quenching process is used, it can be seen: that a high orientation of above 98% was obtained irrespective of the method of molding; and that there was obtained a sintered magnet (permanent magnet) having high magnetic properties in which a maximum energy product was above 54 MGOe, the remanent flux density was above 14.9 kG, and the coercive force was 14 KOe.

Example 2

In the example 2 a Nd—Fe—B alloy raw meal powder was manufactured as described below and, by using the compression molding machine 1 as shown in FIG. 1, orienting step and the molding step were executed to manufacture a predetermined molded body. Thereafter, a sintering step was executed to sinter this molded body in vacuum atmosphere at a temperature of 1020° C. for 6 hours, thereby obtaining a Nd—Fe—B sintered magnet.

As the material for Nd—Fe—B permanent magnet, there was used a material whose composition is 25Nd-3Pr-1Dy-0.95B-1Co-0.2Al-0.05Cu-0.01Ga-0.05Mo-bal.Fe was used. After vacuum fusion, casting was made on water-cooled cupper roll to thereby manufacture into a foil band (strip) of 0.1 mm~0.5 mm. This manufactured alloy raw material was once subjected to coarse grinding in hydrogen grinding step and subsequently subjected to fine grinding by a jet mill fine grinding step, thereby obtaining an alloy raw meal powder.

Further, the compression molding machine 1 was constituted to be able to generate a maximum of 16 kOe of static magnetic field in the cavity 22 having a square opening portion of 7 cm. In an inert gas atmosphere, the cavity 22 was filled with an alloy raw meal powder P. Thereafter, in the static magnetic field of 16 kOe agitation was made by the agitating apparatus 5 (orienting step). In agitating the alloy raw meal powder P, there was used one, similar to that in Example 1, in which screw type of vane of 18-8 stainless steel make was mounted (see FIG. 1). Agitation was executed at the number of rotation of 20000 rpm for 2 seconds. Thereafter, compression molding was executed by the pair of upper and lower punches while charging magnetic field (molding step). The molding pressure in this case was set to a predetermined value. After the compression molding, a reverse magnetic field of 3 kOe was charged for de-magnetization, and then the molded body was taken out of the cavity. As a comparative example, there was manufactured one which was molded without agitation of the alloy raw meal powder in the magnetic field was not executed and then sintered.

FIG. 10 is a table showing an average value of magnetic properties, and rejection rate in inspection of cracks, notches, fissures, and the like of 100 sintered magnets at each of the molding pressures while varying the molding pressure at the time of compression molding. According to this table, it can be seen that: the crystal fractures having an equal crystal orientational relationship are bonded together as a result of rotary agitation in the magnetic field so as to array in the magnetic field orientation without clearance among the crystal fractures; and that by executing the molding step in this state, sintered magnets having high magnetic properties were obtained. In addition, by strongly bonding the crystal fractures having equal crystal orientational relationship, the strength of the molded body itself will also become stronger, resulting in lower rate of occurrence of unacceptable products. It can also be seen that, even in case the rotary agitation was executed, the orientation was disturbed when the molding pressure was below 2.0 t/cm$^2$.

One hundred formed bodies M were manufactured under the same conditions as the above Example 2, and these formed bodies M were wrapped in rubber bags, and were put into the isostatic molding apparatus to thereby mold them at a molding pressure of 1 t/cm$^2$. Thereafter, sintering was executed in the same conditions as those in the above-described Example 2. After sintering, inspection was made of poor quality like the cracks, notches, fissures, and the like. As a result, the rate of occurrence of poor quality was 0%. In this case, the magnetic properties of the sintered magnets were the same as those in the Example 2.

Example 3

In the Example 3, alloy raw meal powder was manufactured in the same method as in the Example 2. By using the compression molding machine as shown in FIG. 1, agitation was executed in the same conditions as in the Example 2 while agitating in the magnetic field by the agitating apparatus 5 to thereby orient in the magnetic field. Thereafter, compression molding was executed and sintered in the same conditions as those in Example 2 to thereby obtain a sintered magnet. In this case, the molding pressure was set to 0.3 t/cm$^2$ and the kind of magnetic field and the intensity of the magnetic field in the orienting step and the molding step were varied.

FIG. 11 is a table showing average values of the magnetic properties when respectively 100 sintered magnets were obtained by varying the kind of the magnetic field and the intensity of the magnetic field. According to this, it can be seen that, in magnetic pulse field, the orientation exceeded 95% at the peak magnetic field of above 10 kOe. On the other hand, in static magnetic field, it can be seen that the orientation exceeded 95% at the magnetic field of above 5 kOe.

Example 4

In the Example 4, Nd—Fe—B alloy raw meal powder was manufactured as described hereinbelow. After mixing lubricant in a predetermined mixing ratio, by using the compression molding machine 1 as shown in FIG. 1 to execute the orienting step and the molding step to manufacture a predetermined molded body. Then, sintering step to sinter the molded body was executed in vacuum atmosphere at a temperature of 1020° C. for 6 hours, thereby obtaining Nd—Fe—B sintered magnet.

As the raw material for Nd—Fe—B permanent magnet, a material having a composition of 25Nd-3Pr-1Dy-0.95B-1Co-0.2Al-0.05Cu-0.01Ga-0.05Mo-bal. Fe was used. After vacuum fusion, casting was made on a water-cooled cupper roll, thereby manufacturing a foil band (strip) of 0.1 mm~0.5 mm. This manufactured alloy material was once subjected to coarse grinding by hydrogen grinding step, and was subsequently subjected to jet mill fine grinding to thereby obtain an alloy raw meal powder P. Then, as the lubricant, solid lubricant, liquid lubricant or solid lubricant and liquid lubricant was added in a predetermined mixing ratio and then mixed. As the solid lubricant, zinc stearate of 99% purity with average particle diameter of 10 μm was used. On the other hand, as the liquid lubricant, there was used one in which fatty acid ester of 99.9% purity and petroleum solvent were evenly mixed and a surface active agent was mixed in a mixing ratio of 1 wt %.

The compression molding machine 1 was constituted to enable to generate static magnetic field of maximum 16 kOe in the cavity 22 having a square opening portion of 7 cm. In an inert gas atmosphere the cavity 22 was filled with alloy raw meal powder P. Thereafter, it was agitated by the agitating apparatus 5 in a static magnetic field of 16 kOe (orienting step). In agitating, there was used one which has mounted thereon a screw type of rotary vane of 18-8 stainless steel make (see FIG. 1) and agitated by rotation at a number of rotation of 60000 rpm for 3 seconds. Thereafter, molding was executed by a pair of upper and lower punches while charging magnetic field (molding step). In this case, the molding pressure was set to 0.5 t/cm$^2$. Then, after compression molding, reverse magnetic field of 3 kOe was charged to demagnetize and, after demagnetization, the molded body was taken out of the cavity.

FIG. 12 is a table showing average values of magnetic properties and orientation at the time of obtaining 100 sintered magnets at the above-described molding pressure while varying the kind of lubricants and the mixing ratio thereof. The orientation is a value obtained by dividing the value of the remanent magnetic flux density by the saturation magnetic flux density at 10 T. According to this, it can be seen that, in case the solid lubricant is used as the lubricating agent, the orientation is improved by adding at a ratio of 0.02 wt %, and that the maximum energy product showing the magnetic properties and the remanent magnetic flux density are improved. It can also be seen: that, in case the solid lubricant was added at a rate of 0.1 wt %, orientation as high as 99% was obtained; and that a permanent magnet of high magnetic properties was obtained in which the maximum energy product was above 55 MGOe, the remanent magnetic flux density was 14.9 kG, and the coercive force was about 14.0 KOe. It is to be noted, however, that when a solid lubricant was added at a ratio of 0.2 wt %, there was obtained a high orientation, but the coercive force lowered under the influence of residual carbon (ash content of lubricant).

Further, in case a liquid lubricant was used as the lubricating agent, when addition was made at the ratio of 0.05 wt %, it can be seen that the orientation improved and the maximum energy product and the residual magnetic flux showing the magnetic properties improved. It can also be seen: that, in case the liquid lubricant was added at a rate of 3 wt %, orientation of as high as 99% was obtained; and that a permanent magnet of high magnetic properties was obtained in which the maximum energy product was above 56.3 MGOe, the remanent magnetic flux density was 15.0 kG, and the coercive force was about 14.0 KOe. It is to be noted, however, that when a liquid lubricant was added at a ratio of 5 wt %, there was obtained a high orientation, but the coercive force slightly lowered. Therefore, it can be seen that, if addition was made over 5 wt %, the coercive force lowered under the influence of residual carbon.

Further, even in case the solid lubricant and the liquid lubricant were used as the lubricant by respectively mixing them at a predetermined ratio, higher orientation was obtained and a permanent magnet of high magnetic properties was obtained.

BRIEF DESCRIPTION OF THE DRAWINGS

FIG. 9 is a table showing magnetic properties and orientation of permanent magnets manufactured in Example 1;

FIG. 10 is a table showing magnetic properties, orientation, and rate of occurrence of unacceptable permanent magnets manufactured in Example 2;

FIG. 11 is a table showing magnetic properties of permanent magnets manufactured in Example 3; and FIG. 12 is a table showing magnetic properties and orientation of permanent magnets manufactured in Example 4.

DESCRIPTION OF REFERENCE NUMERALS

Figure 1:
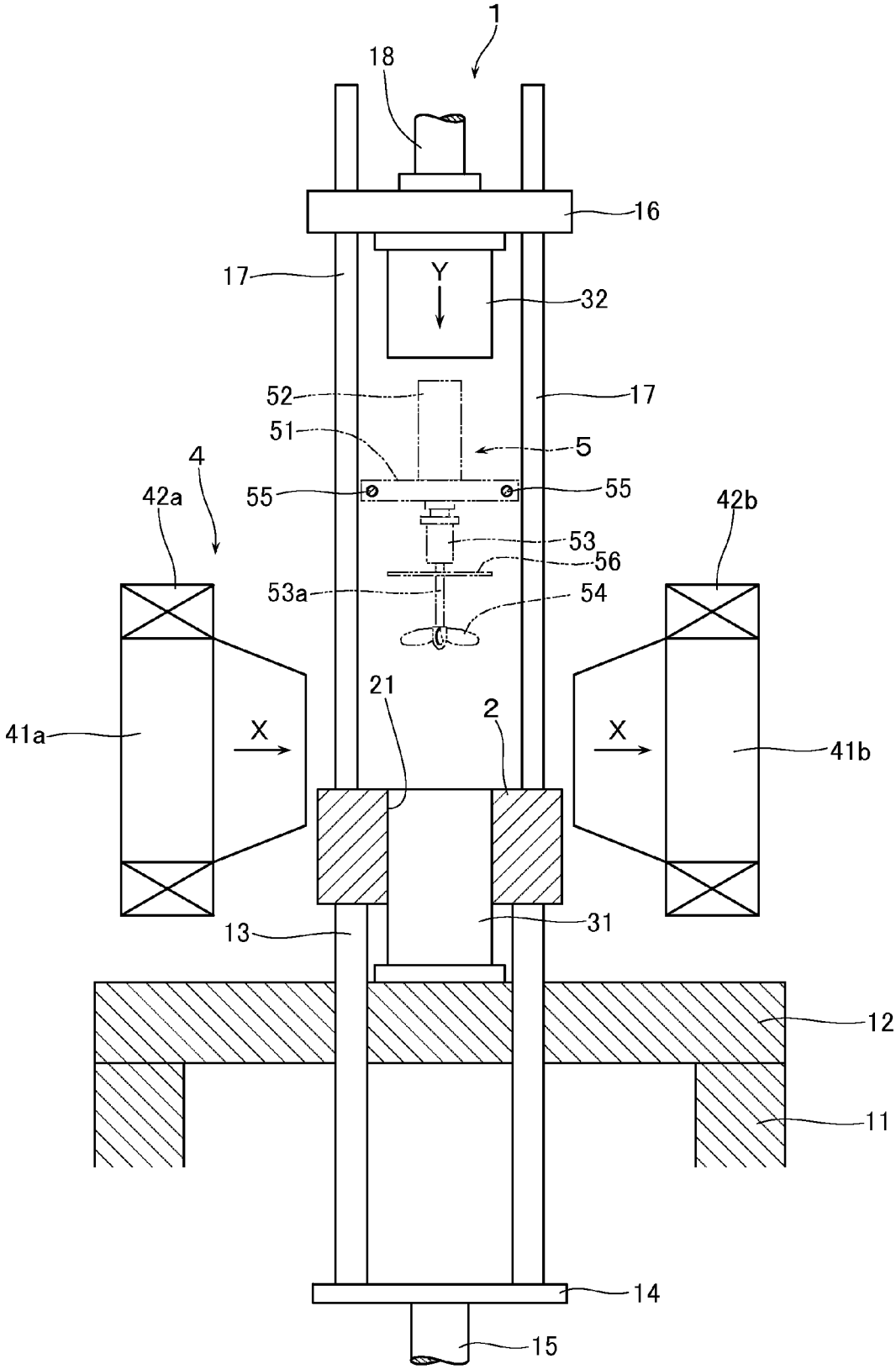
FIG. 1 is a schematic view of a molding apparatus for executing the method of manufacturing according to this invention in a standby position.
Figure 2:
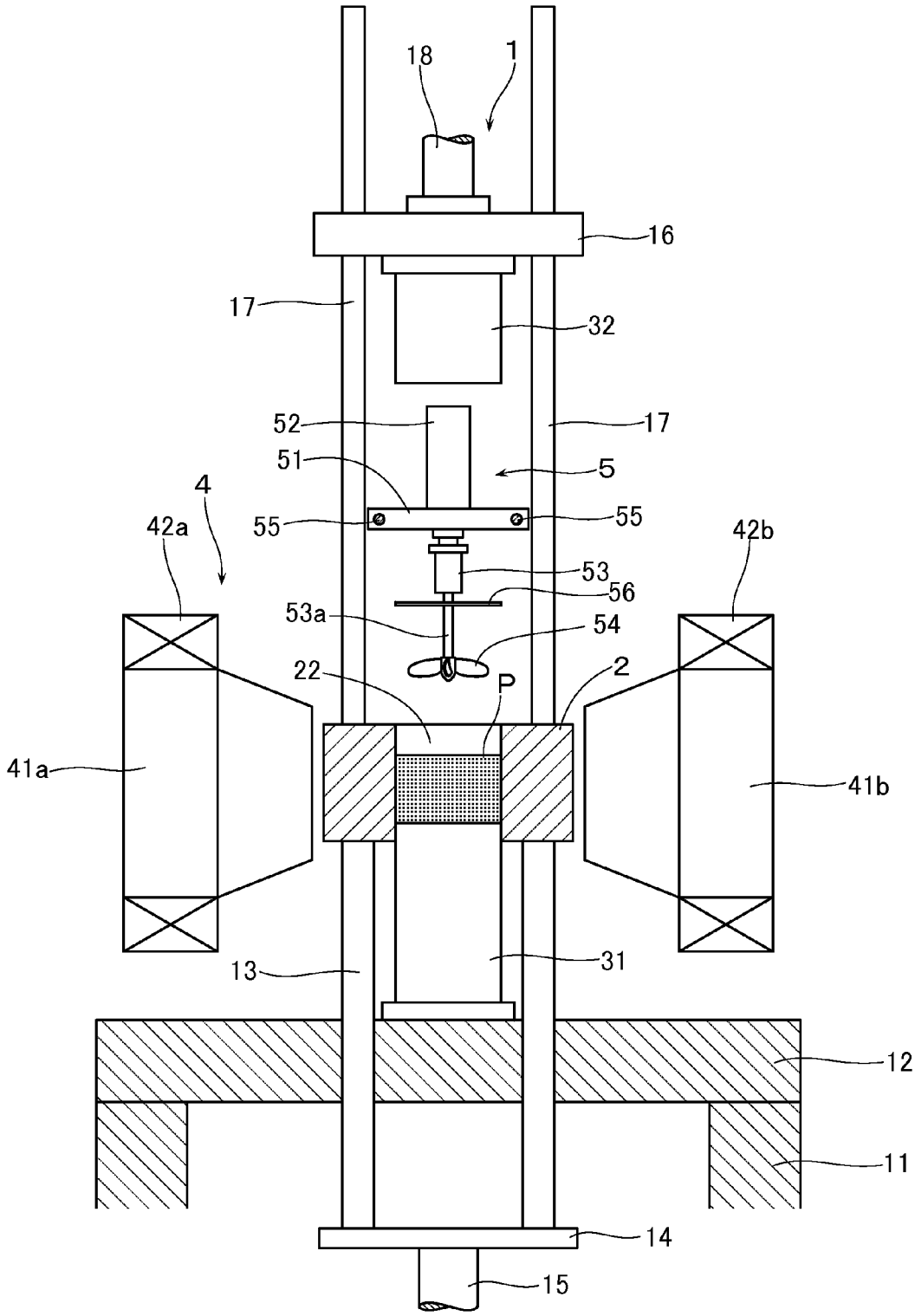
FIG. 2 is a schematic view illustrating the operation of the molding apparatus as shown in FIG. 1.
Figure 3:
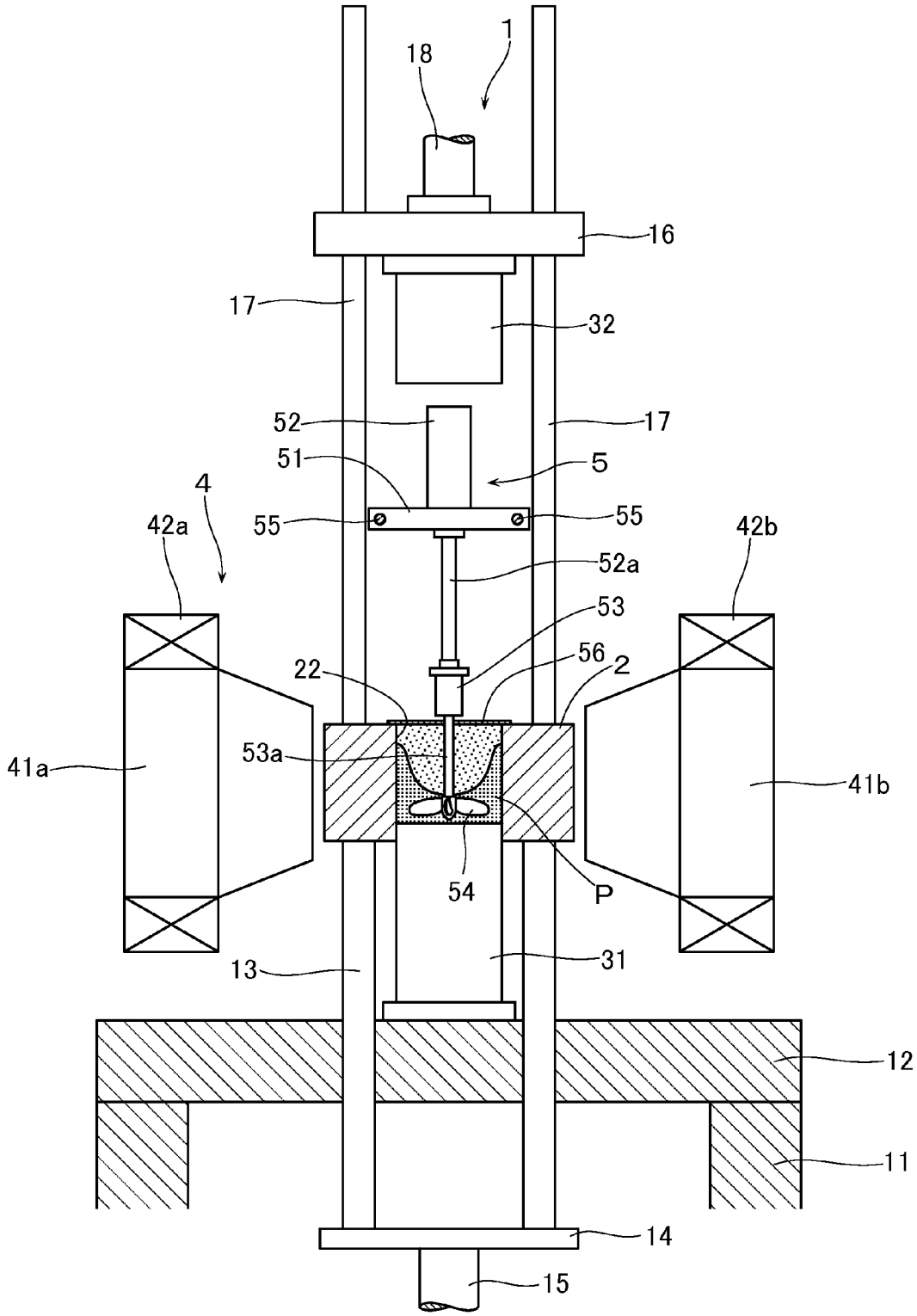
FIG. 3 is a schematic view illustrating the operation (orienting step) of the molding apparatus as shown in FIG. 1.
Figure 4A:
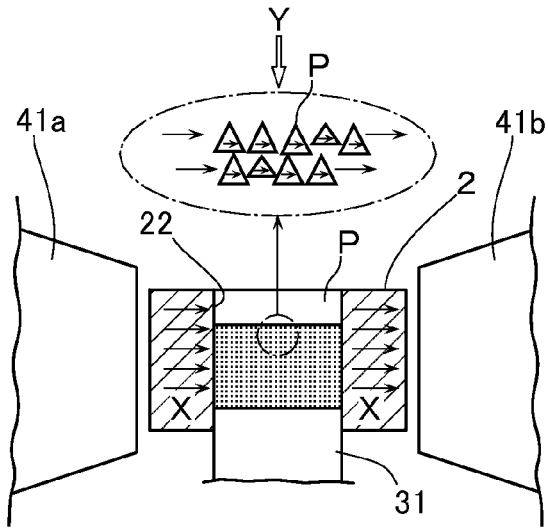
FIG. 4(*a*) is a schematic view illustrating the magnetic field orientation according to the conventional art, and FIG. 4(*b*) is a schematic view illustrating the agitating magnetic field orientation of this invention.
Figure 4B:
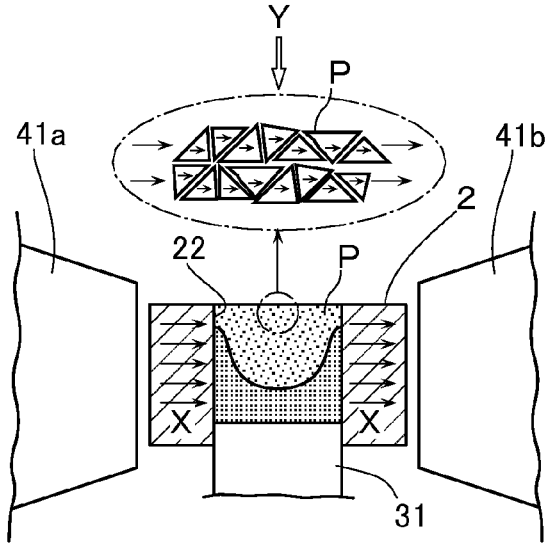
Figure 5:
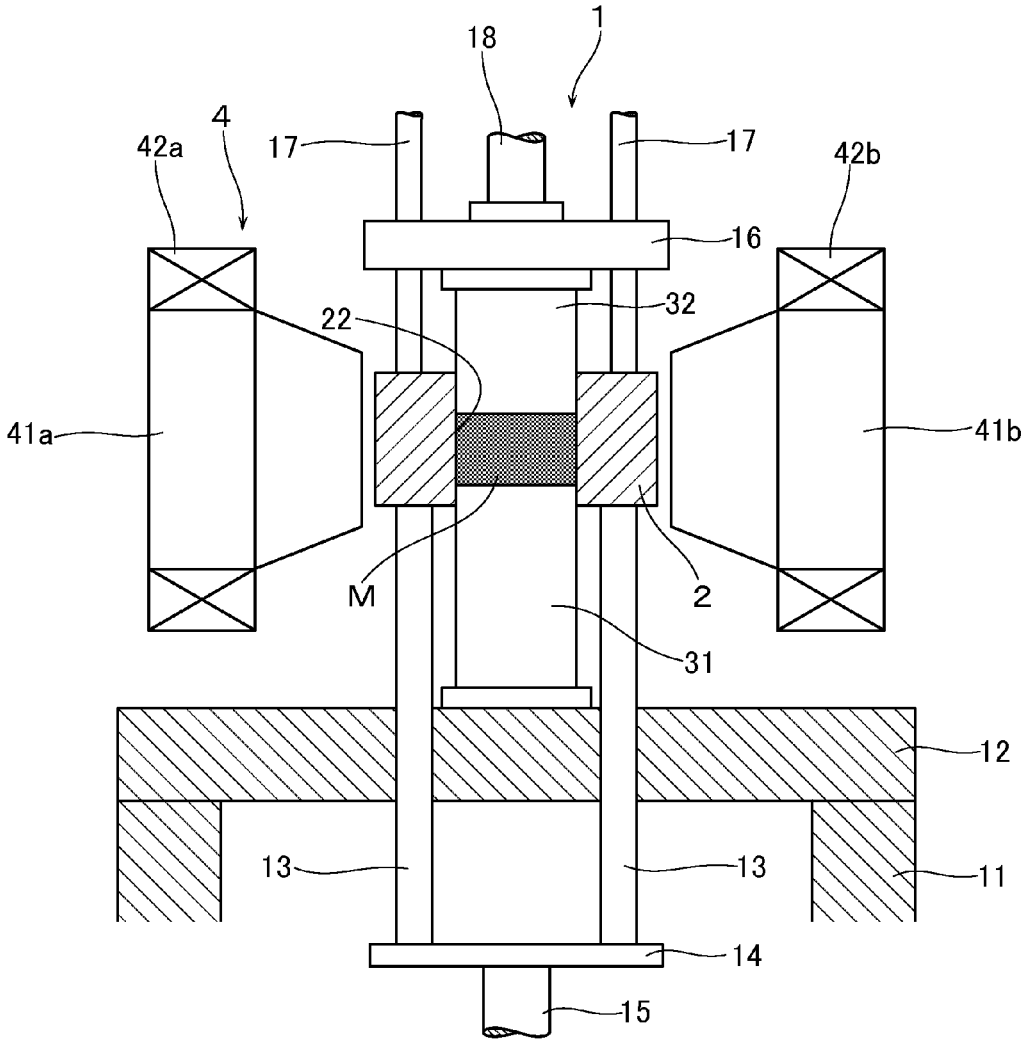
FIG. 5 is a schematic view illustrating the operation (molding step) of the molding apparatus as shown in FIG. 1.
Figure 6:
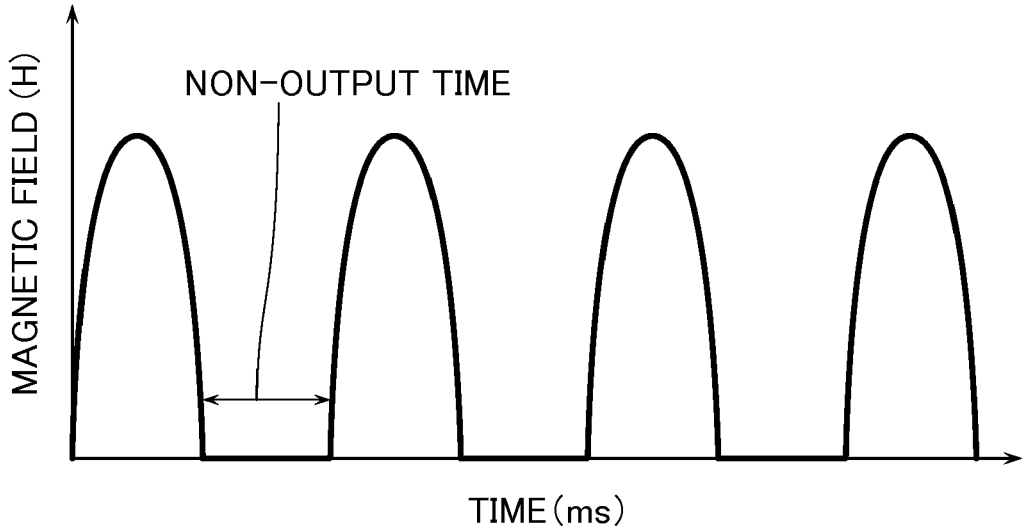
FIG. 6 is a graph illustrating the magnetic pulse field.
Figure 7:
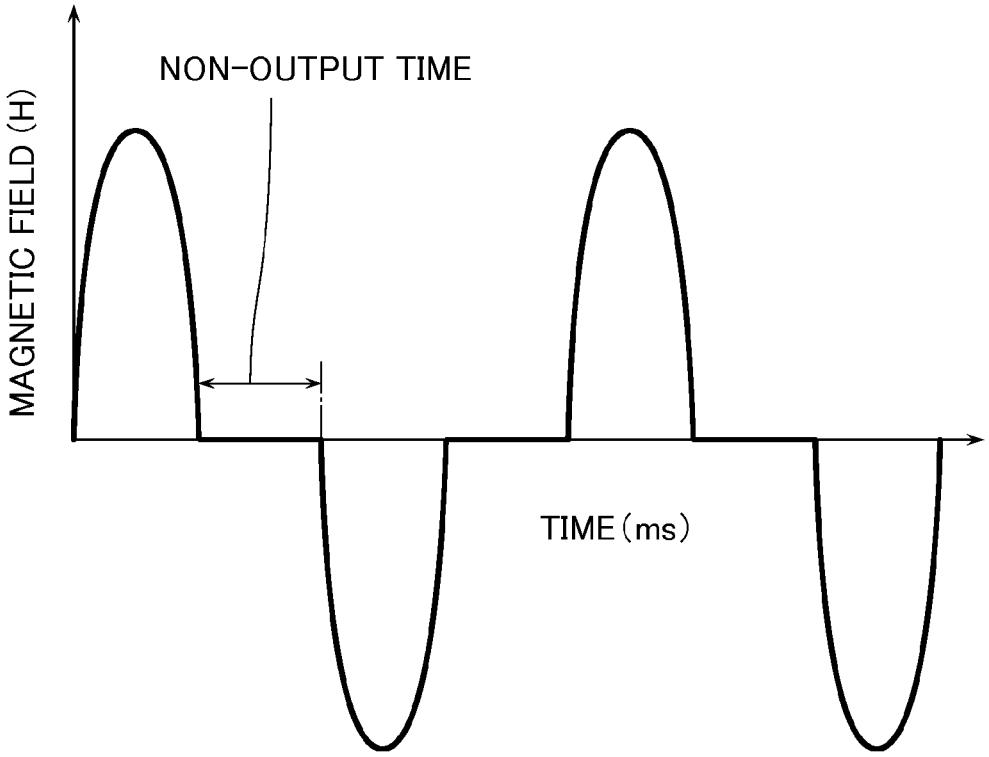
FIG. 7 is a graph illustrating a modified example of the magnetic pulse field.
Figure 8A:
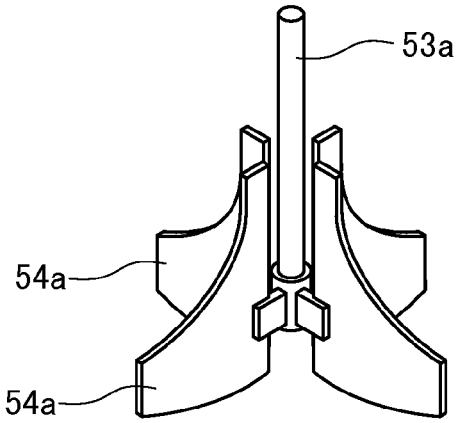
FIG. 8(*a*) through FIG. 8(*c*) are perspective views showing other embodiments of rotary vanes to be used in an agitating apparatus.
Figure 8B:
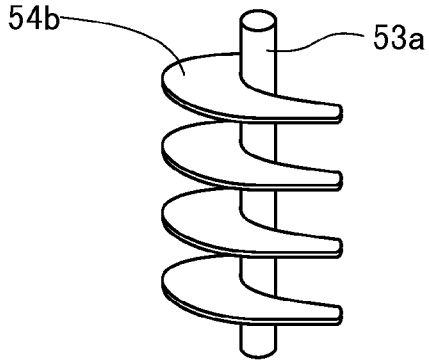
Figure 8C:
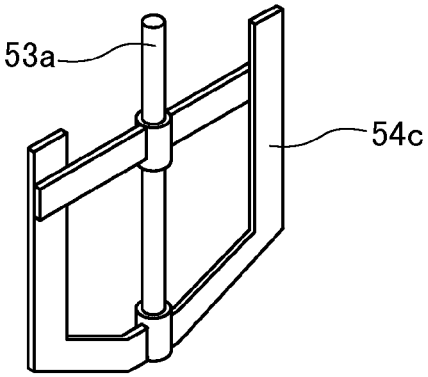

1 compression molding machine
2 die
21 penetrating hole
22 cavity
31, 32 punches

4 magnetic field generating apparatus
5 agitating apparatus
54 rotary vane
56 lid body
P alloy raw meal powder

What is claimed is:

1. A method of manufacturing an oriented body comprising:

filling a filling chamber with powder that is polarized in magnetic field or electric field;

agitating the powder directly by means for agitating in the filing chamber; and orienting, while agitating, the powder in magnetic field or electric field.

2. A method of manufacturing a molded body comprising:

a first step of filling a filling chamber with powder that is polarized in magnetic field or electric field, agitating the powder directly by means for agitating in the filing chamber, and orienting in the magnetic field or electric field, while agitating, the powder in the filling chamber; and a second step of compression molding the powder oriented in the first step in the magnetic field or electric field.

3. A method of manufacturing a sintered body comprising:

a first step of filling a filling chamber with powder that is polarized in magnetic field or electric field, agitating the powder directly by means for agitating in the filing chamber, and orienting, while agitating, the powder in the filling chamber;

a second step of compression molding, in magnetic field or electric field, the powder oriented in the first step; and a third step, in addition to or in place of the second step, of sintering the oriented body or compression-molded body.

4. A method of manufacturing a permanent magnet comprising:

an orienting step of filling a filling chamber with alloy raw metal powder, agitating the powder directly by means for agitating in the filing chamber, and orienting, while agitating, the alloy raw metal powder in the filling chamber in magnetic field; and a first molding step of compression molding the alloy raw metal powder oriented in the orienting step to a predetermined shape in magnetic field.

5. The method of manufacturing a permanent magnet according to claim 4, wherein the alloy raw metal powder having mixed thereto a lubricant in a predetermined mixing ratio is filled into the filling chamber.

6. The method of manufacturing a permanent magnet according to claim 5, wherein a solid lubricant is used as the lubricant, and wherein the mixing ratio is set to a range of 0.02 wt %~0.1 wt %.

7. The method of manufacturing a permanent magnet according to claim 5, wherein a liquid lubricant is used as the lubricant, and wherein the mixing ratio is set to a range of 0.05 wt %~5 wt %.

8. The method of manufacturing a permanent magnet according to claim 5, wherein a mixture in a predetermined mixing ratio of a solid lubricant and a liquid lubricant is used as the lubricant.

9. The method of manufacturing a permanent magnet according to claim 4, wherein the first molding step is executed by a uniaxial pressurizing type of compression molding machine, and wherein a compression molding pressure is set to a range of 0.1 $t/cm^2$~1 $t/cm^2$.

10. The method of manufacturing a permanent magnet according to claim 9, further comprising a second molding step in which the molded body obtained in the first molding step is molded in isostatic molding.

11. The method of manufacturing a permanent magnet according to claim 4, wherein the first molding step is executed by an isostatic molding machine, and wherein a compression molding pressure is set to a range of 0.3 $t/cm^2$~3.0 $t/cm^2$.

12. The method of manufacturing a permanent magnet according to claim 4, further comprising a sintering step, in addition to or in place of the first molding step, of sintering the oriented body or compression-molded body.

13. The method of manufacturing a permanent magnet according to claim 12, wherein the alloy raw metal powder is for a rare earth magnet manufactured by a quenching process.

14. The method of manufacturing a permanent magnet according to claim 12, wherein the agitation of the alloy raw metal powder is executed with an agitating means made of a non-magnetic material.

15. The method of manufacturing a permanent magnet according to claim 12, wherein at least one of the orienting step and the first molding step is executed in static magnetic field, and wherein the intensity of the magnetic field is set to a range of 5~30 kOe.

16. The method of manufacturing a permanent magnet according to claim 12, wherein at least one of the orienting step and the first molding step is executed in magnetic pulse field, and wherein the intensity of the magnetic field is set to a range of 5~50 kOe.

17. The method of manufacturing a permanent magnet according to claim 4, wherein the alloy raw metal powder is for a rare earth magnet manufactured by a quenching process.

18. The method of manufacturing a permanent magnet according to claim 4, wherein the agitation of the alloy raw metal powder is executed with an agitating means made of a non-magnetic material.

19. The method of manufacturing a permanent magnet according to claim 4, wherein at least one of the orienting step and the first molding step is executed in static magnetic field, and wherein the intensity of the magnetic field is set to a range of 5~30 kOe.

20. The method of manufacturing a permanent magnet according to claim 4, wherein at least one of the orienting step and the first molding step is executed in magnetic pulse field, and wherein the intensity of the magnetic field is set to a range of 5~50 kOe.

* * * * *